United States Patent [19]

Knickerbocker

[11] Patent Number: 4,603,935

[45] Date of Patent: Aug. 5, 1986

[54] MULTIPLE ELECTRICAL CONNECTOR BLOCK WITH IMPROVED WIRE WRAP PINS

[75] Inventor: Robert H. Knickerbocker, Cheshire, Conn.

[73] Assignee: The Siemon Company, Watertown, Conn.

[21] Appl. No.: 537,070

[22] Filed: Sep. 29, 1983

[51] Int. Cl.[4] ..... H01R 9/00

[52] U.S. Cl. ..... 339/97 P; 339/198 R

[58] Field of Search ..... 339/97 R, 97 P, 98, 339/99 R, 198 R, 276 A

[56] References Cited

U.S. PATENT DOCUMENTS

| | | | |
|---|---|---|---|
| 3,112,147 | 11/1963 | Pferd et al. | 339/198 R |
| 3,132,913 | 5/1964 | Pohl | 339/97 P |
| 3,964,816 | 6/1976 | Narozny | 339/276 A |
| 4,381,880 | 5/1983 | Pohl | 339/210 M |
| 4,403,820 | 9/1983 | Rich | 339/97 R |
| 4,408,391 | 10/1983 | Pohl | 29/861 |
| 4,425,019 | 1/1984 | Pohl | 339/97 R |
| 4,440,466 | 4/1984 | Pohl | 339/97 P |

*Primary Examiner*—Gil Weidenfeld
*Assistant Examiner*—Gary F. Paumen
*Attorney, Agent, or Firm*—Fishman & Dionne

[57] ABSTRACT

A connector block including wire-formed multiple solderless connectors having an improved wire wrap pin assembly is presented. The block has retainer and body sections with slots and bridge elements to house and define rows and columns of the connectors. The block is further provided with improved wire wrap pins which project from one side of the block and which are in mechanical and electrical contact with the wire-formed solderless connectors. In a preferred embodiment, the wire wrap pins have a two-pronged fork mounted on a rod-like base portion.

16 Claims, 5 Drawing Figures

MULTIPLE ELECTRICAL CONNECTOR BLOCK WITH IMPROVED WIRE WRAP PINS

BACKGROUND OF THE INVENTION

The present invention relates to the field of multiple electrical connectors and mounting blocks therefor. Specifically, the present invention is directed to a new and improved mounting block for wire-formed solderless multiple connectors.

Solderless multiple connectors have found applicability in many fields, particularly in the field of telephonic equipment. These connectors may be used to establish interconnections between small diameter, insulated conductors in confined spaces where the use of screw type terminal strips or similar connecting devices are not suitable. In addition, some of these prior art connectors strip away the insulation from conductors inserted therein.

U.S. Pat. No. 3,132,913 relates to a solderless multiple connector formed from continuous strips of wire formed and shaped in adjacent and abutting loops so as to receive and electrically contact electrically conductive wire between abutting sections of loops. The wire formed solderless connector shown in U.S. Pat. No. 3,132,913 was intended as an improvement on and had several advantages over prior art clip type connectors of the type generally shown in U.S. Pat. No. 3,112,147 and which are sometimes referred to in the art as "66 Type" connectors.

The subsequent U.S. Pat. No. 4,381,880 is an improvement over deficiencies in U.S. Pat. No. 3,132,912. U.S. Pat. No. 4,381,880 relates to a mounting block for solderless connectors having a retainer and a body section which defines slots for housing terminal defining conductive elements. These conductive elements are formed from wire to define linearly aligned plural loops between which wires may be inserted. The conductive elements are arranged in uniformly spaced horizontal rows and vertical columns of terminals.

While a serious disadvantage of the connectors disclosed in U.S. Pat. No. 3,132,913 has been the lack of tails or wire wrap pins, an attempt has been made to devise a suitable wire wrap pin for use in conjunction with the connectors described in U.S. Pat. No. 4,381,880. These wire wrap pins were disclosed in U.S. patent application Ser. No. 271,431, now U.S. Pat. No. 4,425,019, which is assigned to the assignee of the present invention and incorporated herein by reference. Unfortunately, the tails or pins described therein suffer from certain unacceptable deficiencies. For example, the wire wrap pins of U.S. Ser. No. 271,431, now U.S. Pat. No. 4,425,019, comprise a plurality of rod-like pins which are press fit through apertures and subsequently positioned and frictionally engaged between adjoining loops. In order to accomplish this engagement, the springy loops are spacially separated from each other so that the straight wire wrap pins are compressively held therebetween. While suitable for its purposes, the structure of U.S. application Ser. No. 271,431, now U.S. Pat. No. 4,425,019, may have some drawbacks. The rod-like pins may be dislodged through inadvertent motions during subsequent repair work. Further, the standard loop structure of the connector must be altered to accommodate the insertion of pins and spacer elements. Also, the retainer must be formed with spacer members which fit between those connector loops without wire wrap pins to effect the spacial separation.

SUMMARY OF THE PRESENT INVENTION

The present invention overcomes the above discussed disadvantages and other deficiencies of the prior art by providing a connector assembly utilizing wire-formed multiple connector elements and including improved wire wrap pins.

In accordance with the present invention, a multiple terminal solderless electrical connector as described in prior application U.S. Ser. No. 271,603, now U.S. Pat. No. 4,440,466, and incorporated herein by reference, is formed from a length of wire. The wire is alternately looped to form two oppositely facing rows of loops. A first row of loops is formed with relatively straight parallel sides, while the second row of loops, which interconnect the loops of the first row, is formed with inwardly converging sides. The loops of the first row are configured so that the straight side portions of adjacent loops are in intimate contact to form an individual connector.

The mounting block is provided with slots for receiving the wire connectors. The dimensions of the slots are such so that the wire connectors are prevented from lateral movement and constrained from any type of displacement. The connectors are positioned within the mounting blocks so that the first row of loops is exposed for receiving wire conductors. The mounting block is further provided with a plate for retaining the connectors within the blocks.

The plate supports a plurality of improved wire wrap pins which are press-fit into the retaining plate and positioned to make electrical contact with specific connector loops. In a preferred embodiment of the present invention, the wire wrap pin has the shape of a two-pronged fork. Electrical contact between the pin and connector loops is then accomplished by positioning and fitting the bottom portion of a loop in the notch between the prongs of a pin.

The tails or wire wrap pins of the present invention provide improved electrical and mechanical contact with the connecting loops. Furthermore, the pins permit retention of the advantageous feature of abutting contact between loops, as in U.S. Pat. No. 4,381,880. Finally, the absence of retainers with special spacer-members allow improved flexibility in modifying pin placement and location as well as lower manufacturing costs.

DESCRIPTION OF THE DRAWING

The present invention may be better understood and its numerous objects and advantages will become apparent to those skilled in the art by reference to the accompanying drawing wherein like reference numerals refer to like elements in the several FIGURES and wherein.

DESCRIPTION OF THE PREFERRED EMBODIMENT

Figure 2:
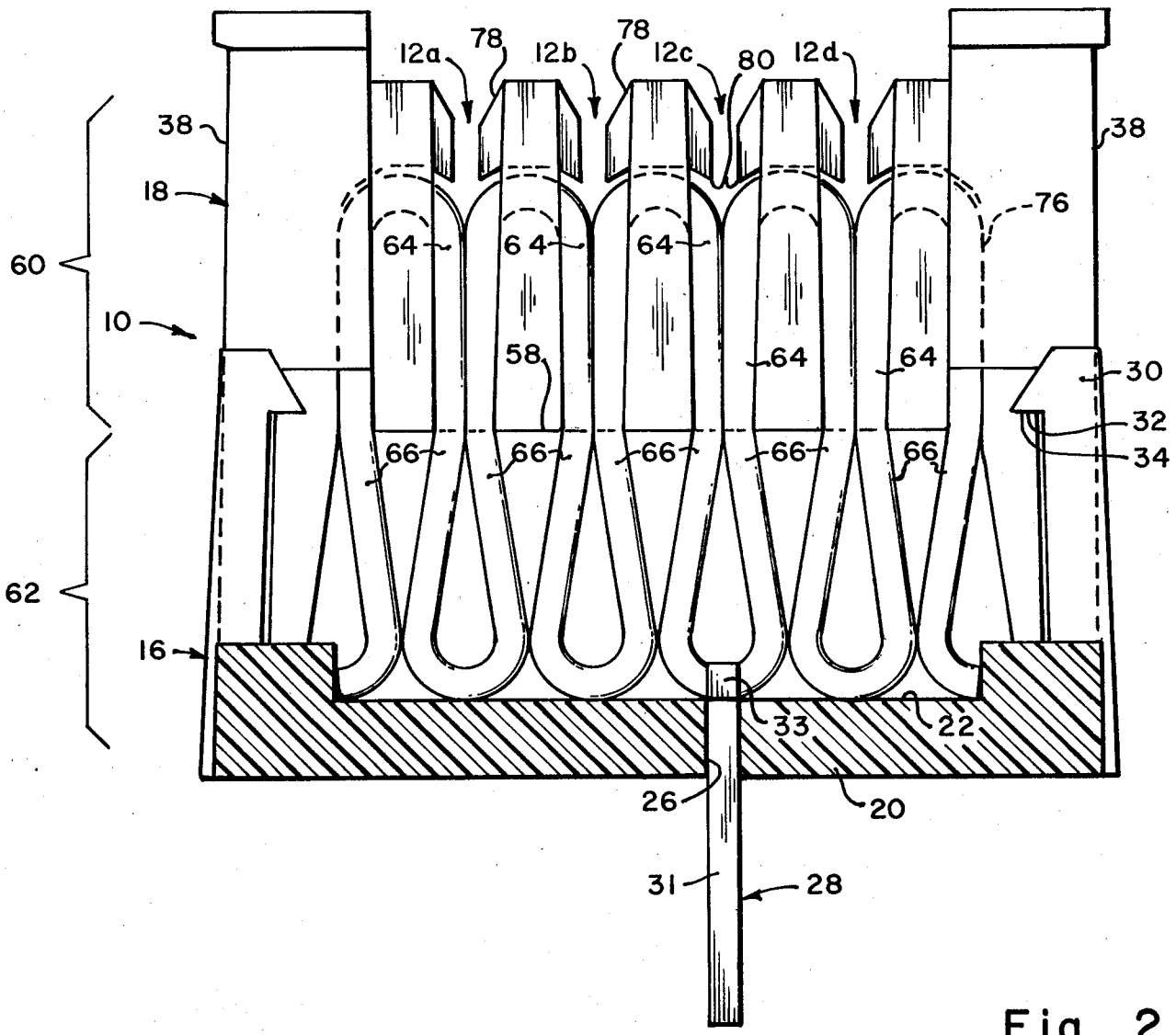
FIG. 2 is a cross-sectional side elevation view of the connector block of FIGS. 1(A) and 1(B) in assembled form and with an embodiment of a wire wrap pin installed.
Figure 3:
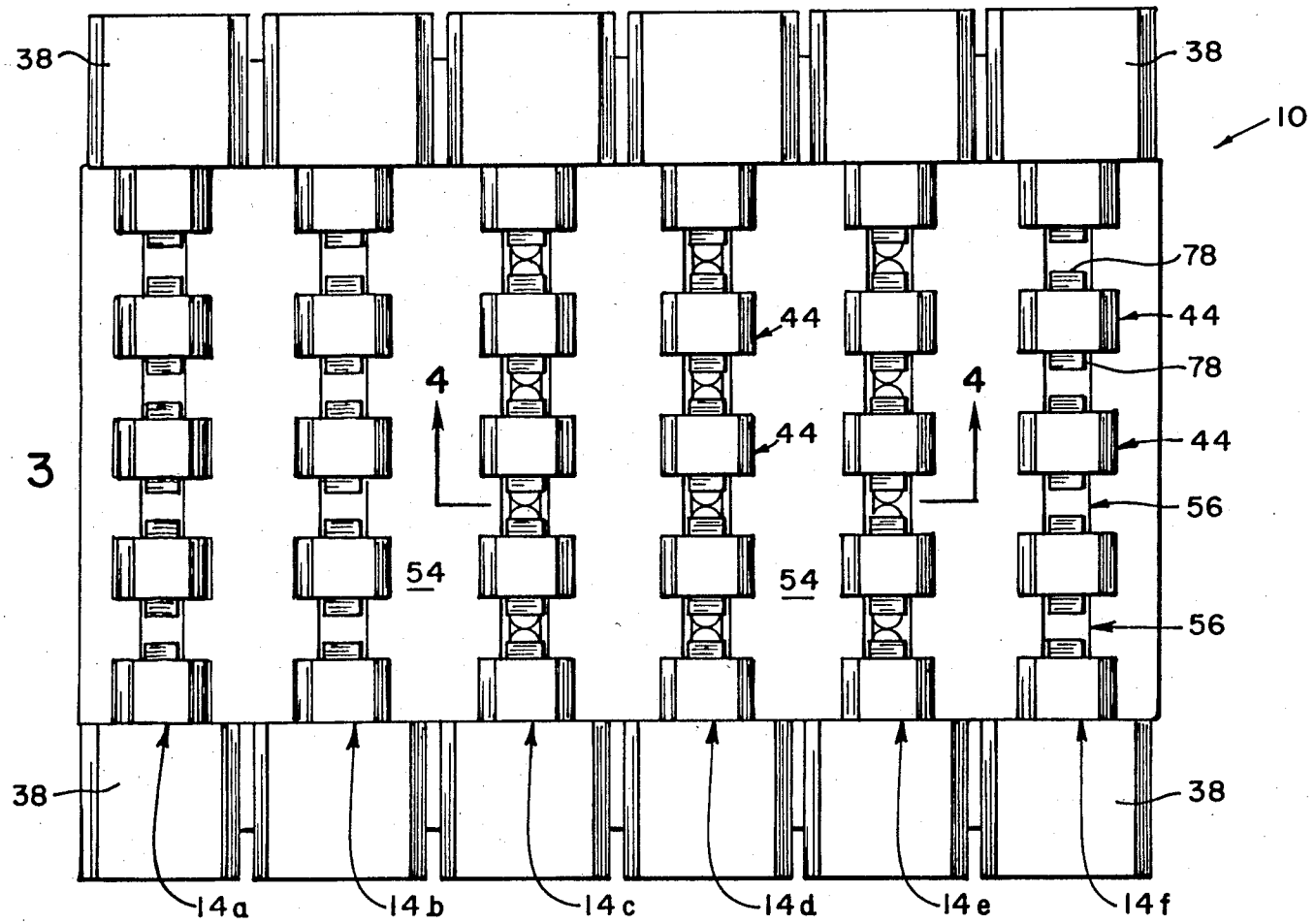
FIG. 3 is a top plan view of the connector block of FIG. 1.

FIGS. 2 and 3 show a block, generally indicated at 10, for 24 connector locations, arranged in a four-by-six array. That is, front to back of the block there are four columns of connector locations, each of which has six rows from side to side. While the details which make up these four columns and six rows will be discussed in more detail hereinafter, the four columns are generally indicated at 12(*a*) through 12(*d*) in FIG. 2, and the six rows are generally indicated at 14(*a*) through 14(*f*) in FIG. 3. Of course, it will be understood that any desired number of rows and columns can be used, and the four-by-six array is merely for purposes of illustration.

Figure 1B:
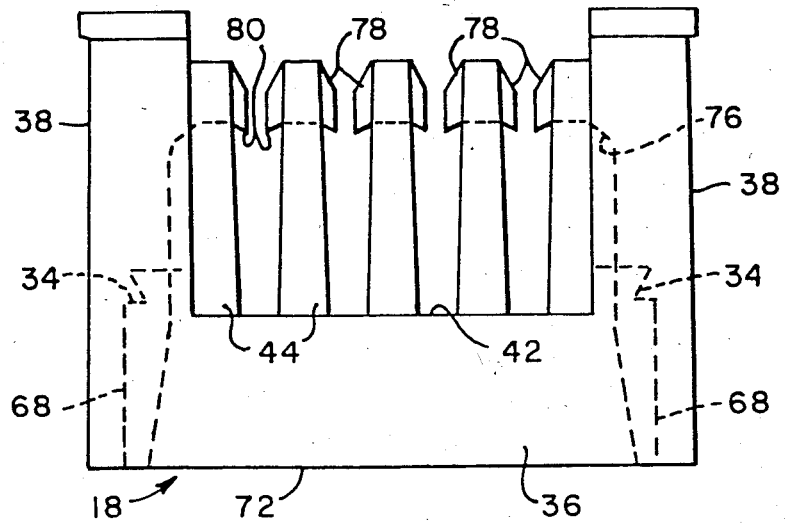
FIGS. 1(A) and 1(B) are side elevation views of the two portions of a connector block in accordance with the present invention with internal elements being shown in phantom.
Figure 1A:
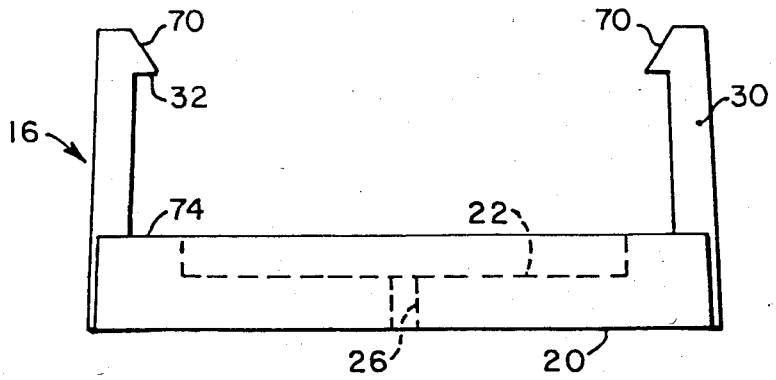

Block 10 is comprised of two basic interlocking parts. These two parts are a retainer 16 and a main body unit 18, both of which are molded plastic elements. For purposes of clarity and understanding, retainer 16 and main body unit 18 are separately shown in FIGS. 1(A) and 1(B) respectively. FIGS. 1(A) and 1(B) thus depict separate non-conductive parts of the assembled unit shown in FIGS. 2–5. In a preferred embodiment, retainer 16 has a base portion 20 with a series of latitudinal (side to side) slots 22 therein corresponding to the number of rows of conductive connector elements to be housed in the block. A representative aperture 26 is provided through the base 20 of retainer 16 and will be in alignment with a bridge 44 (see FIG. 4) body unit 18 when the retainer and body unit are assembled. It should be understood that while only one aperture 26 and wire wrap pin 28 are shown, any number of apertures and pins may be employed depending on the particular circumstances. A wire wrap conductive pin 28 of the present invention is press fit into aperture 26 as shown in FIG. 2.

In a preferred embodiment, wire wraps 28 are comprised of an electrically conductive material. In this embodiment, the head of a pin 28 is shaped like a two-pronged fork 29 while the base portion 31 has a rod-shape. A cross piece or shoulder 33 is symmetrically attached to base 31 and supports fork members 29. Fork members 29 form an opening or notch 37 therebetween. The fork-shaped pin 28 necessitates a series of longitudinal slots 23 that run perpendicular to the latitudinal (side to side) slots 22 (which correspond to the rows of connector elements in the blocks). At each intersecting point of slots 22 and 23 are apertures 26. The apertures 26 will be aligned between a pair of adjacent bridges 44 in body unit 18 when the retainer and body unit are assembled. Thus, when a fork-shaped pin 28 is inserted through aperture 26, the rod-shaped base portion 31 slides through the aperture until the shoulder 33 communicates and is supported by slot 23 in retainer 16. When the main body section 18 is snapped onto retainer 16, the forks 29 frictionally engage the arcuate portion, i.e., center, of a lower connector loop. The connector loop is then firmly held in the notch 37 thereby creating electrical and mechanical contact.

Retainer 16 also has a plurality of locking arms 30 which extend upwardly from base 20 along each side of the retainer. Locking arms 30 are slightly resilient and springy, so that they can be deflected outwardly and then spring or snap back into place to lock retainer 16 and main body unit 18 together. The upper part of each locking arm 30 has an inwardly projecting locking surface or shoulder 32 which engages a corresponding locking surface or shoulder 34 on main body unit 18.

Figure 4:
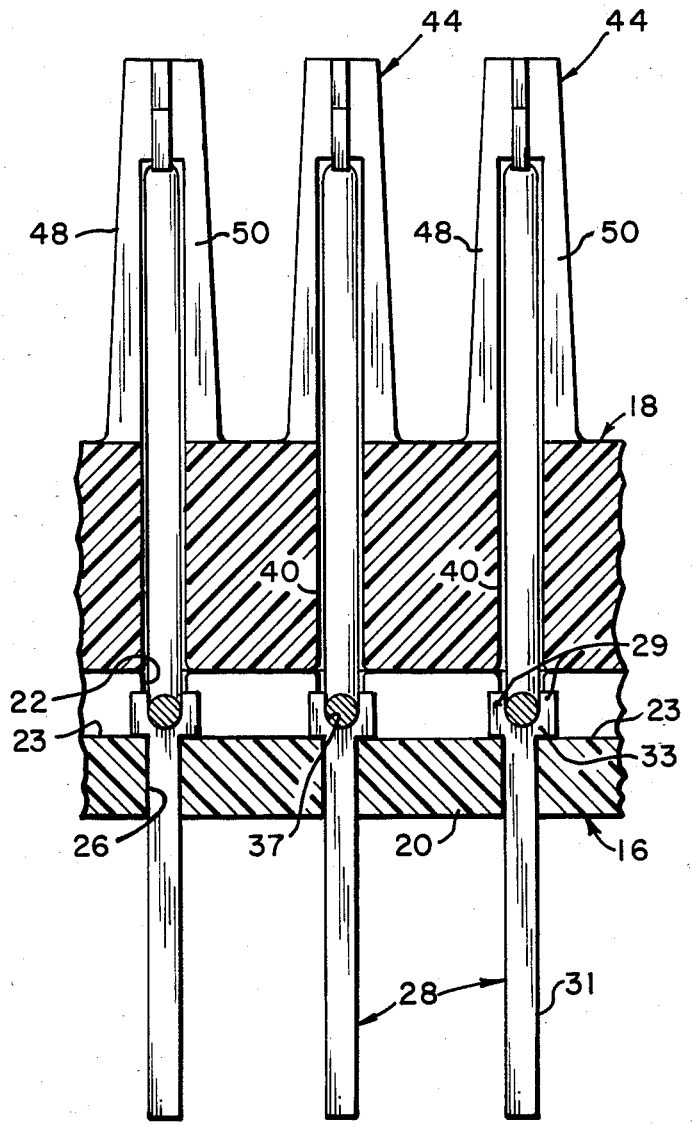
FIG. 4 is a partial sectional detail taken along line 4—4 of FIG. 3, FIG. 4 being a view which is transverse to FIG. 2.

Referring now to FIGS. 1(A), 1(B) and 2, main body unit 18 has a main body portion 36 with two fanning strips, defined by posts 38, running along each side. The fanning strips serve as a means of orderly entry into the block for the insulated conductors of a comunications cable or system which are to be electrically connected to solderless connectors in the block. Main body unit 18 includes, in body portion 36, a plurality of latitudinal slots 40 which correspond to and are in alignment with each of the latitudinal slots 22 in base 20 of retainer 16. Body unit 18 has an internal floor or surface area 42 from which a series of inverted U-shaped bridges 44, which are integrally molded parts of main body unit 18, project. The outermost of bridges 44 are integral with posts 38 of the fanning strips. Each bridge 44 has a passage or opening 46 in alignment with the slots 22 and 40. As will be described in more detail hereinafter, the slots 22 and 40 and the passages 46 serve to house and position rows of wire-formed solderless connectors. In the embodiment shown in the drawings, there are six rows of the aligned slots 22 and 40. Each bridge 44 can be considered to be made up of a pair of uprights 48 and 50, joined together by a cross piece 52, which define the passages 46. It will, of course, be understood that all of the bridges 44 are of similar construction, so only illustrative ones are marked in the drawings. As best shown in FIGS. 3 and 4, the bridges are spaced apart to define open rows 54 in which to run wires from the fanning strips. As may be seen from FIG. 3, the bridges 44 are also spaced to define columns 56 through which access is had to connect the conductors of wires to the connector elements housed in the block.

With reference to FIG. 2, a wire-formed solderless connector is indicated generally at 58. Connector 58 is formed from any suitable electrically conductive wire stock having sufficient resiliency. The wire stock is bent to form two coplanar opposite facing rows of loops 60 and 62, respectively. The loops of upper row 60 are formed with straight parallel sides 64, while the loops of lower row 62 are formed with inwardly converging sides 66. The radius of the curved portion of lower loops 62 is less than that of the curved portion which connects the straight sides of upper loops 60. The straight parallel sides 64 of adjacent of upper loops 60 are in contact and define therebetween individual connectors. In use, an insulated wire conductor, not shown, is inserted between two adjacent sides 64. As the wire is forced downwardly between two adjacent loops in row 60, any insulation is sheared away at the contact point between the upper loop sections. This shearing action is partly a result of the dimensioning of passages 46 which retains the connectors against lateral movement. This shearing action is diminished as the conductor is forced between the sides 64, since these sides 64 are allowed to bow outwardly. Restated, the multiple terminal connectors 58 function as end-supported beams.

As can be seen from the FIGURES and the above discussion, the wire wrap pins 28 of the present invention overcomes the previously discussed limitations of, the structure of prior application Ser. No. 271,431, now U.S. Pat. No. 4,425,019. Also, with the arrangement of the present invention, modification of pin positioning is easily accomplished, simply by disengaging a particular pin from the retainer 16 and, if desired, reinserting the disengaged pin in any other desired aperture 26. The improved structures for securing and stabilizing the pins 28 located in the retainer 16 and main body 18, as previously discussed, help to improve the electrical contact and mechanical retention of the wire wraps. Finally, unlike the wire wrap structure of prior application Ser. No. 271,431, now U.S. Pat. No. 4,425,019, the lower row of loops 62 do not need to be spacially separated and supported since the pin embodiments of the present invention are not positioned between adjoining lower loop sections. This allows the use of standard connector loops having a more inexpensive structure.

In assembling a block in accordance with the present invention, the wire-formed solderless connectors 58, one of such row type connectors being clearly seen in FIG. 2, are loaded into the slots 40 and bridge passages 46 of main body unit 18. Retainer 16 is then placed in position relative to the main body unit, with the slots 22 in alignment with the connectors 58, and the base and main body unit are then moved together to come into locking engagement. As can best be seen in FIGS. 1(A) and 1(B), the innermost extension of shoulder 32 on the locking arms 30 overlaps main body surfaces 68 over which the arms must slide in assembling the unit. Thus, when assembling the unit, the inclined surfaces 70 on arms 30 will be engaged by surfaces 68, whereby the locking arms 30 are cammed and deflected outwardly as retainer 16 and main body unit 18 are moved together. When the retainer and main body unit have been positioned so that the bottom 72 of body portion 36 is adjacent to the floor 74 of retainer body 20, the locking arms snap inwardly with locking shoulder 32 overlapping cooperating shoulder 34 to complete the assembly of the block. In this manner, the wire-formed connector strips are locked and retained in place in the block and are ready to receive single or plural, insulated or bare, single conductor or stranded wires to be mounted thereon.

With particular attention to FIGS. 2 and 4, an important feature of this connector is illustrated in that each row of wire connectors 58 is fully retained against movement or deflection toward any adjacent row, since the lower loops of each wire connector row are fully captured in a slot 22, and the connector rows are also captured in slots 40 and the bridge passages 46 in bridges 44. Thus, each wire connector row is fully constrained against displacement which would create misalignment and interfere with the insertion of wires. Also, bridges 44, expecially cross pieces 52, shield the wire connectors and prevent short circuiting by outside objects which might fall into or otherwise come into contact with the top of the block, this protection being realized without the need for a separate cover on the block.

The present invention not only retains each row of wire-formed connectors against deflection toward an adjacent row, but also resists lateral deflection of each connector row when a conductor is inserted therebetween. As clearly seen in FIGS. 2 and 4, each wire-formed multiple connector 58 is snuggly captured within slots 40 of main body 18 and passages 46 of U-shaped bridges 44. The upper loops at each end of each connector are retained against outward movement by the upper side walls 76 of the outermost of bridges 44. Each loop of each connector wire is also prevented from overlapping the adjacent loops by the uprights 48 and 50 of bridges 44 and thus the bridges function to stiffen the upper loops of the connectors.

The lateral retention and stiffening of the upper loops or portions of the wire-formed connectors 58 within the block 10 is another important feature of a connector in accordance with the present invention. Since the upper loop portions of the wire connectors are prevented from lateral movement when an electric wire is inserted therebetween, wire insertion results in a high compression force which strips away the insulation from the conductor of the wire. This compressive force decreases as the conductor is forced downwardly between a pair of cooperating loops of the connector, since the two straight portions of the wire connector are allowed to bend outwardly as shown in FIG. 1. This prevents cold flow of the conductor as it is inserted into the connector. Thus, to summarize, the loops of the wire-formed connector generate a high force upon initial wire insertion and the high force strips any insulation from the wire. When fully inserted, however, the wire is positioned between straight sections of the connector, i.e., between straight sections of end supported beams which can bend. The application of a force which is initially high and which decreases in the direction of wire insertion is completely contrary to prior art practice.

Another important feature attributable to the above-discussed lateral retention is that the insertion of two or more conductors between a single pair of loops of the connector will not force apart the upper loop portions. This assures that the insulation will be stripped away, even after repeated use. It should thus be apparent to those skilled in the art that even after repeated use of the connectors of the present invention there will be no outward expansion of the upper loop portions which would diminish their insulation stripping function. Also, the connector blocks of the present invention will reliably receive and retain multiple electrical conductors at each connector location.

Referring now to FIGS. 1(B) and 2, wings or projections 78 are located at the top part of each bridge 44. These wings 78 extend between and toward adjacent bridges within a row, so that they narrow the gap between adjacent bridges within each row. The tops of adjacent wings 78 on adjacent bridges 44 are inclined to define a lead in area or ramp to guide an electric wire into position for insertion in the connector block and electrical and mechanical attachment to the wire formed in the block. As can also be seen in FIGS. 1(B) and 2, each wing 78 terminates in a downwardly pointed end surface 80 which serves as a retention mechanism to hold the electrical wire in place in anticipation of connection to the wire-formed connector strip. This retention mechanism is effected due to the fact that the insulation covering on a wire conductor is slightly compressed as it passes through the opening defined by wings 78 between adjacent bridges 44, and the pointed ends 80 frictionally engage and retain the outer insulation of the wire. Thus, a conductor to be inserted in the connector can be placed in the block in anticipation of eventual connection, and will be relatively firmly retained in place until the insertion-connection operation is actually performed. Thus, the winged extensions 78 of bridges 44 serve both to provide lead-ins for the wires and retain the wires in place in anticipation of connection to the connectors in the block. The wires to be connected to the block will, typically, be lead into the block through the open rows 54 between adjacent posts 38 of the fanning strips, and the wires will then be laid into the position discussed immediately above with respect to FIG. 1 in anticipation of eventual connection to the wire-formed connector strip 58.

The actual mechanical and electrical connection of conductor wire to wire connector 58 will, typically, be effected by means of a wire insertion tool somewhat similar to the general type presently used for inserting wires into "66 Type" connectors of the type shown in U.S. Pat. No. 3,132,913. A tool designed for use with the connector block of the present invention is disclosed in co-pending application Ser. No. 233,983 filed Feb. 12, 1981, now U.S. Pat. No. 4,408,391, and assigned to the assignee of the present invention. Mechanical and electrical connection of a wire conductor to connector 58 is effected by forcing the wire downwardly between adjacent loops of wire connector 58. The wire conductor will typically be forced down to floor 42. As this happens, as described above, the insulation is sheared and adjacent straight sections of the loops of the connector are subsequently urged apart, and generate strong spring return forces, so that firm physical and electrical contact is established between the wire core of the electrical conductor and the adjacent loop surfaces of wire connector 58.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A block for housing a plurality of electrically conductive wire-formed connector elements of the type having oppositely facing and interconnected upper and lower rows of loops, the block including:

a retainer section, said retainer section having opposite first and second surfaces;

a plurality of latitudinal rows of spaced slots extending into said retainer section from said first surface;

at least some of said spaced slots of said retainer section being provided with apertures, said apertures each being positioned so as to be disposed under about the center of a lower loop of one of said wire-formed connector elements, said apertures commuicating with said retainer section second surface;

at least one elongated electrically conductive pin means, said pin means being positioned and retained within one of said apertures of said spaced slots, portions of said pin means extending outwardly beyond both of said first and second surfaces of said retainer section, said portion of said pin means extending from said first surface of said retainer section having notch means to form mechanical and electrical contact with the center of a lower loop of one of said wire-formed connector elements;

a main body section connected to said retainer section first surface.

2. A block as in claim 1 wherein said pin means comprises:

a pair of fork members defining a first end of said pin means and having a cross-piece supporting said fork members, said cross-piece and said fork members defining said notch means whereby said loop is frictionally engaged therein; and a rod-shaped base portion connected to said cross-piece defing a second end of said pin means.

3. A block as in claim 2 further including:

a plurality of longitudinal rows of spaced slots in said retainer section perpendicular to said latitudinal rows of spaced slots and capable of receiving and supporting said pin means.

4. A block as in claim 1 wherein a wire conductor is mechanically and electrically connected to said second end of said pin means.

5. A block as in claim 2 wherein a wire conductor is mechanically and electrically connected to said second end of said pin means.

6. A block as in claim 1 including:

a plurality of rows of spaced slots in said main body section in alignment with corresponding roews of slots in said retainer section;

a plurality of bridge elements on said main body section in bridging alignment with the slots in each row of said main body section, each bridge element defining a passage in alignment with corresponding slots in the main body section and the retainer section;

said corresponding retainer slots, main body slots and bridge passages cooperating to define housings for rows of electrically conductive wire-formed connector elements;

said bridge elements in each row being spaced apart and in alignment with bridge elements in other rows to define spaced columns for connection of electrical conductors to said wire-formed connector elements; and means for releasably joining said retainer section and said main body section together.

7. A block as in claim 1 wherein:

said main body section has a floor spaced from said retainer section; and said bridge elements extend from said floor away from said retainer section.

8. A block as in claim 7 wherein:

each of said bridge elements is an inverted U-shaped element integrally molded with the block and having uprights joined together by a cross piece.

9. A block as in claim 6 wherein:

each of said bridge elements is an inverted U-shaped element integrally molded with the block and having uprights joined together by a cross piece.

10. A block as in claim 16 wherein:

bridge elements in each row have projections at the top thereof extending toward adjacent bridge elements in the row.

11. A block as in claim 10 wherein:

said projections on adjacent bridge elements cooperate to define a lead in area for insertion of an electrical conductor.

12. A block as in claim 11 wherein:

said projections on adjacent bridge elements cooperate to define retaining means to retain an electrical conductor therebetween prior to connection to one of said wire-formed connector elements.

13. A block as in claim 10 wherein:

said projections on adjacent bridge elements cooperate to define retaining means to retain an electrical conductor therebetween prior to connection to one of said wire-formed connector elements.

14. A block as in claim 10 wherein:

adjacent projections on adjacent bridge elements define a space for alignment with conductor receiving portions of one of said wire-formed connector elements housed in the block.

15. A block as in claim 6 including:

fanning strips on the sides of said main body section;

said fanning strips defining passages in alignment with spaced rows between rows of said bridges for entry of electrical conductors.

16. A block as in claim 6 wherein:

said releasable joining means includes locking arms extending from said retainer section, and locking surfaces on said main body section for locking engagement with said locking arms.

* * * * *